US007179333B2

(12) United States Patent
Woolley et al.

(10) Patent No.: US 7,179,333 B2
(45) Date of Patent: Feb. 20, 2007

(54) CLOSURE SEALANT DISPENSER

(75) Inventors: Scott J. Woolley, Golden, CO (US); William W. Weil, Golden, CO (US); Ian J. Buckley, Littleton, CO (US); James N. McBride, Arvada, CO (US)

(73) Assignee: Computrol, Inc., Golden, CO (US)

( * ) Notice: Subject to any disclaimer, the term of this patent is extended or adjusted under 35 U.S.C. 154(b) by 427 days.

(21) Appl. No.: 10/670,176

(22) Filed: Sep. 23, 2003

(65) Prior Publication Data

US 2004/0115346 A1 Jun. 17, 2004

Related U.S. Application Data

(60) Provisional application No. 60/412,988, filed on Sep. 23, 2002.

(51) Int. Cl.
*B05B 13/06* (2006.01)
*B05C 5/00* (2006.01)

(52) U.S. Cl. ..... 118/318; 118/306; 118/319; 118/320

(58) Field of Classification Search ..... 118/306, 118/317, 318, 52, 319, 320, 300; 427/256, 427/284, 207.1
See application file for complete search history.

(56) References Cited

U.S. PATENT DOCUMENTS

| | | | | |
|---|---|---|---|---|
| 1,639,118 | A | | 8/1927 | Troyer et al. |
| 1,782,450 | A | | 11/1930 | Taylor |
| 1,838,082 | A | | 12/1931 | Coyle |
| 2,189,283 | A | | 2/1940 | Eberhart |
| 2,287,356 | A | | 6/1942 | Newman |
| 2,419,951 | A | * | 5/1947 | Kastel ..... 118/317 |
| 2,587,538 | A | | 2/1952 | Seaman |
| 2,732,315 | A | | 1/1956 | Birkland |
| 2,896,378 | A | * | 7/1959 | Keating ..... 451/307 |
| 3,001,586 | A | | 9/1961 | Kyle |
| 3,412,971 | A | | 11/1968 | McDivitt |
| 3,521,598 | A | | 7/1970 | Straw |
| 3,575,131 | A | * | 4/1971 | Lohmann ..... 118/699 |
| 3,612,479 | A | | 10/1971 | Smith, Jr. |
| 3,641,959 | A | | 2/1972 | Hurst |
| 3,761,053 | A | | 9/1973 | Bedo et al. |
| 3,780,981 | A | | 12/1973 | Horak et al. |
| 3,852,095 | A | | 12/1974 | Hogstrom |
| 3,876,144 | A | | 4/1975 | Madden et al. |
| 4,262,629 | A | | 4/1981 | McConnellogue et al. |
| 4,295,573 | A | | 10/1981 | Terry et al. |
| 4,342,443 | A | | 8/1982 | Wakeman |
| 4,437,488 | A | | 3/1984 | Taggart et al. |
| 4,498,415 | A | | 2/1985 | Tsuchiya et al. |
| 4,546,955 | A | | 10/1985 | Beyer et al. |
| 4,840,138 | A | | 6/1989 | Stirbis |

(Continued)

*Primary Examiner*—Yewebdar Tadesse
(74) *Attorney, Agent, or Firm*—William W. Cochran; Cochran Freund & Young LLC

(57) ABSTRACT

A machine for applying sealant material to non-circular closures using a rotating chuck connected to a rotational motor and a fixedly mounted dispensing apparatus. The chuck is also moved in at least one linear direction in a plane normal to the rotational axis of the chuck. The rotational motor may be connected to the chuck using various mechanisms while minimizing the moving mass of the machine. Sealant applicators are also disclosed that are mounted on a turret and use independently controlled motors, or fully integrated servomotors to rotate the chuck.

11 Claims, 12 Drawing Sheets

U.S. PATENT DOCUMENTS

| | | | | |
|---|---|---|---|---|
| 4,852,773 | A | 8/1989 | Standlick et al. | |
| 4,884,720 | A | 12/1989 | Whigham et al. | |
| 4,958,769 | A | 9/1990 | Schowiak | |
| 5,197,508 | A | 3/1993 | Gottling et al. | |
| 5,215,587 | A | 6/1993 | McConnellogue et al. | |
| 5,263,608 | A | 11/1993 | Kiernan et al. | |
| 5,272,902 | A | 12/1993 | Kobak | |
| 5,296,035 | A | 3/1994 | Chicatelli et al. | |
| 5,419,492 | A | 5/1995 | Gant et al. | |
| 5,455,067 | A | 10/1995 | Chicatelli et al. | |
| 5,476,362 | A | 12/1995 | Kobak et al. | |
| 5,533,853 | A | 7/1996 | Wu | |
| 5,564,877 | A | 10/1996 | Hamilton | |
| 5,636,447 | A | 6/1997 | Yount et al. | |
| 5,749,969 | A | 5/1998 | Kobak et al. | |
| 5,945,160 | A | 8/1999 | Kobak et al. | |
| 6,010,740 | A | 1/2000 | Rutledge et al. | |
| 6,113,333 | A | 9/2000 | Rutledge et al. | |
| 6,391,387 | B1 | 5/2002 | Rutledge et al. | |
| 2003/0184744 | A1* | 10/2003 | Isozaki et al. | 356/237.2 |

* cited by examiner

CLOSURE SEALANT DISPENSER

CROSS REFERENCE TO RELATED APPLICATIONS

The present application is based upon and claims the benefit of U.S. Provisional Patent Application Ser. No. 60/412,988 by William W. Weil, et al., entitled "Can Sealant Dispenser" filed Sep. 23, 2002, the entire contents of which is hereby specifically incorporated by reference for all it discloses and teaches.

BACKGROUND OF THE INVENTION a. Field of the Invention

The present invention pertains generally to machines that dispense sealant material to closures and specifically to the dispensation of sealer material to non-circular and circular can or bottle closures.

b. Description of the Background

Sealant is often applied to closures such as can lids and bottle lids prior to joining the closures to the container body. The sealant, also known as "compound" within the industry, may be dispensed in liquid form on the closure. The dispensing technology is well developed for circular can closures.

Non-circular cans, such as rectangular, square, oval, or ham-shaped, pose a significant difficulty for application of the sealant. The need to precisely control the amount of sealant while processing the closure at a high rate of speed poses a high degree of difficulty for the machine designer. Maintenance of high-speed machines further dictates that machines must be designed to be as simple and easy to repair as possible.

The sealant should be dispensed in a controlled manner to limit any excess sealant material on the closure. Excess sealant, while not dangerous if in contact with foodstuffs, adds additional costs to the can and may be squeezed out of the intended location during the process of seaming the closure to the can. Given the large number of closures that may be processed, saving a small amount of sealant on each can closure can translate into substantial cost savings. The prior art includes machines for placing sealant onto circular closures. These machines generally have a sealant dispenser that dispenses the sealant material onto a spinning closure. The closures are presented to the sealant dispenser on a chuck that lifts the closure into place and rotates the closure underneath the sealant dispenser. Machines for dispensing sealant material onto circular closures are capable of running at very high speeds.

However, methods for placing sealant onto non-circular closures have been only marginally successful. One method is similar to pad printing wherein an applicator places the sealant material onto a non-circular can closure by pressing a sealant-dipped applicator onto the closure periphery surface. Such printing-type methods use a large amount of sealant and are not very accurate. These techniques are only used for small batch runs.

An additional method for placing sealant onto non-circular closures is to position the closure under a showerhead and flood the periphery of the closure with sealant. This method also uses large amounts of sealant, and is not very accurate. Additionally, the showerheads require constant cleaning and blocked holes can cause a gap in the sealant.

In another machine, a sealant dispenser is moved in and out along a radius with respect to the rotating axis of the closure. Such machines are a simple modification to the existing circular closure-processing machine. However, the mass of the sealant dispenser limits the speed at which the machine may operate. Such a system is shown in U.S. Pat. No. 6,391,387 issued to Rutledge, et al. on May 21, 2002 which is specifically incorporated herein by reference for all that it discloses and teaches.

It would therefore be advantageous to provide a high speed, highly accurate method and apparatus for dispensing sealant to irregularly shaped closures.

SUMMARY OF THE INVENTION

The present invention overcomes the disadvantages and limitations of the prior art by providing a system and method for applying sealant to closures by controlling the movement of the closure with respect to the stationary sealant dispenser in an accurate and high speed manner.

The present invention may therefore comprise a method of applying sealant to a non-circular closure comprising: loading the closure onto a chuck, the closure having a periphery about which the sealant is to be applied, the periphery defining a plane; positioning the chuck so that the closure is in alignment with a stationary sealant dispenser; rotating the chuck about an axis substantially perpendicular to the plane defined by the periphery and simultaneously translating the chuck in at least one linear axis within the plane such that the periphery of the closure is maintained in alignment with the sealant dispenser; dispensing the sealant about the periphery while the closure is simultaneously rotating and translating with respect to the sealant dispenser; and unloading the closure from the chuck.

The present invention may further comprise a closure sealant applicator machine for dispensing sealant to the periphery of non-circular closures comprising: a sealant dispenser substantially fixedly mounted to the sealant applicator machine; a chuck adapted to hold the closure in a plane; a rotational motor in rotational communication with the chuck, the chuck adapted to rotate along an axis substantially perpendicular to the plane; a translational mechanism adapted to linearly move the chuck along at least one axis within the plane; and a controller adapted to simultaneously rotate and translate the closure with respect to the sealant dispenser to maintain the periphery of the closure in alignment with the sealant dispenser while the sealant dispenser dispenses the sealant.

The present invention may further comprise a non-circular closure having sealant applied to the periphery manufactured by a method comprising: loading the closure onto a chuck, the closure having a periphery about which the sealant is to be applied, the periphery defining a plane; positioning the chuck so that the closure is substantially aligned with a stationary sealant dispenser; rotating the chuck about an axis substantially perpendicular to the plane and simultaneously translating the chuck in at least one direction within the plane such that the periphery of the closure is maintained in alignment with the sealant dispenser; dispensing the sealant about the periphery while the closure is simultaneously rotating and translating with respect to the sealant dispenser; and unloading the closure from the chuck.

The present invention may further comprise a non-circular closure having sealant applied to the periphery manufactured by a method comprising: loading the closure onto a chuck, the chuck being mounted onto a rotating turret, the closure having a periphery about which the sealant is to be applied, the periphery defining a plane; positioning the chuck so that the closure is substantially aligned with a sealant dispenser that is fixedly mounted on the rotating turret; rotating the chuck about an axis substantially normal to the plane and simultaneously moving the chuck in a radial direction on the turret such that the periphery of the closure is maintained in alignment with the sealant dispenser.

The present invention may further comprise a circular closure having sealant applied to the periphery manufactured by a method comprising: loading the closure onto a chuck, the chuck mounted onto a rotating turret, the closure having a periphery about which the sealant is to be applied, the periphery defining a plane; positioning the chuck so that the closure is substantially aligned with a sealant dispenser that is fixedly mounted on the rotating turret; rotating the chuck about an axis independent of any rotation derived by the rotation of the turret.

An advantage of various embodiments of the present invention is that sealant may be dispersed on a non-circular closure at very high speeds. Further, a minimum of sealant material is dispensed using various embodiments of the present invention due to the accurate and repeatable, yet high speed positioning of the non-circular closure with a substantially fixedly mounted sealant dispenser.

An additional advantage of the present invention is that standard motors, servomotors or all-in-one, fully integrated servomotor systems can be used that are mounted on rotating turrets that allow independent control of the rotating chuck from the rotational speed of the turret, which allows another degree of control over each dispensing station.

DETAILED DESCRIPTION OF THE INVENTION

Figure 1:
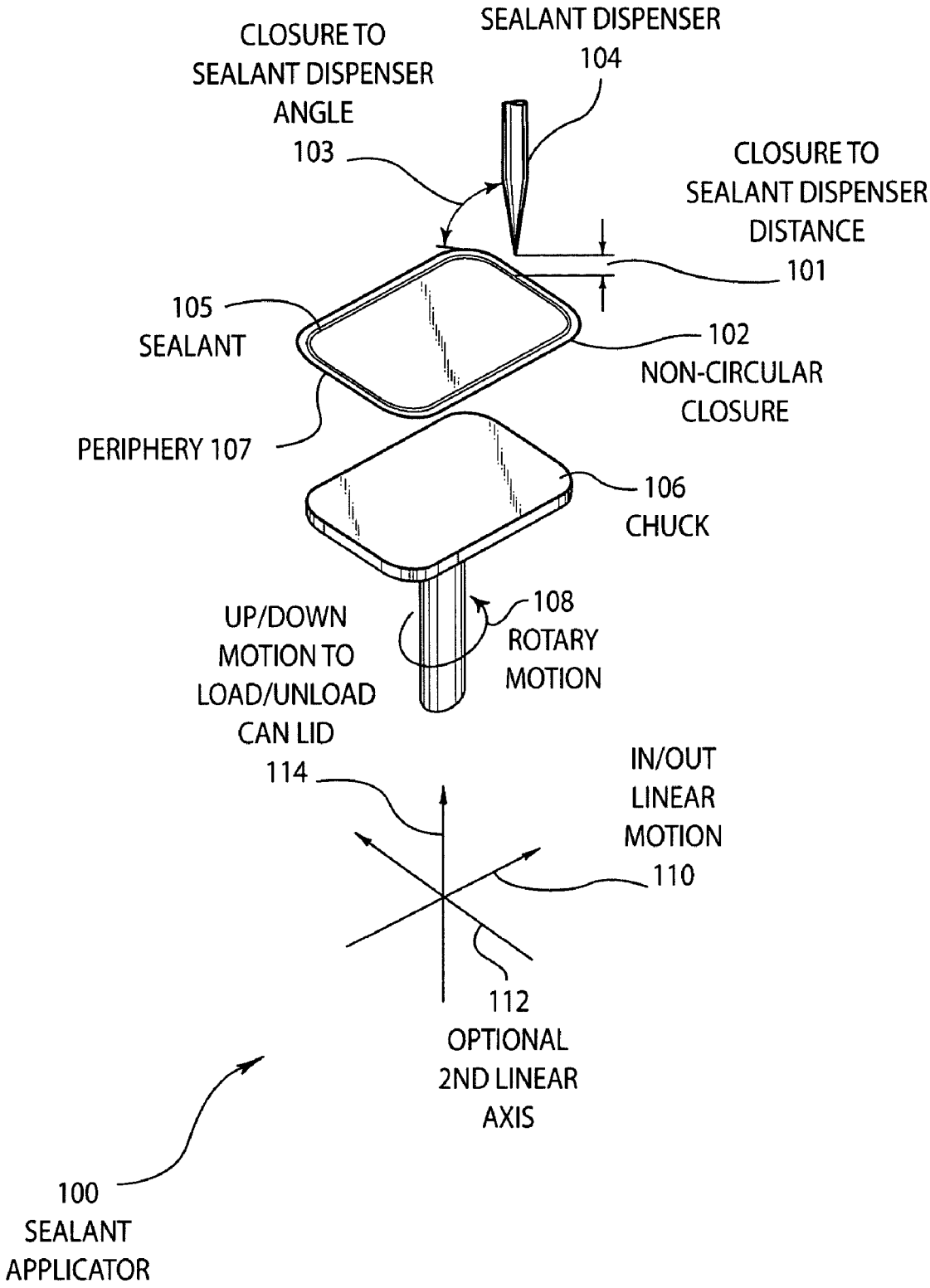
FIG. 1 is a schematic representation of various elements of one embodiment of the present invention.

FIG. 1 illustrates a schematic representation of the various elements 100 of the present invention. A non-circular closure 102 is shown with a sealant dispenser 104 and the sealant 105 applied to the periphery of the closure 102. The closure 102 is supported by a chuck 106 that may hold the closure 102 mechanically, magnetically, with the aid of vacuum or any way desired by the user. The chuck 106 moves with a rotary motion 108 and an in/out linear motion 110 to position the closure 102 under the sealant dispenser 104 to apply the sealant 105. An optional second linear axis of motion 112 may be used to position the closure 102. A vertical motion 114 is used to lift the closure 102 into position.

The sealant 105 is to be dispensed around the outer periphery of the closure 102. The distance 101 and the angle of presentation 103 between the closure 102 and the sealant dispenser 104 remain the same during application of the sealant. In some cases, the sealant may form a bead 1 mm wide and be placed under a curled edge of the closure 102. In such situations, the positioning of the closure 102 under and in alignment with the sealant dispenser 104 may need to be precise within 0.1 mm. In general, the more precisely the sealant may be applied, the less sealant is necessary to produce a seal when the closure 102 is subsequently sealed on an enclosure such as a can lid or bottle lid. Of course, there is a practical limit to the amount of sealant that needs to be present to seal the can.

In the various embodiments of the present invention, the sealant dispenser 104 is maintained in a substantially fixed position while the closure 102 is rotated with respect to the sealant dispenser 104. In order to move in a path so that the sealant may follow the periphery 107 of the closure 102, the chuck 106 is positioned underneath and in alignment with the sealant dispenser 104. The chuck is simultaneously rotated and moved in an in/out linear motion 110 in a plane defined by the periphery 107 of closure 102. In some cases, a second horizontal axis positioning system may also be used, which is represented by motion 112.

The closure 102 may be presented to the processing machine using various conveying technologies. The up/down motion 114 may be used to lift closure 102 into position under the sealant dispenser 104. After processing, the motion 114 may lower the chuck 106 so that the closure 102 may be removed from the apparatus and a second closure may be placed in position under the sealant dispenser 104 for processing.

Figure 2:
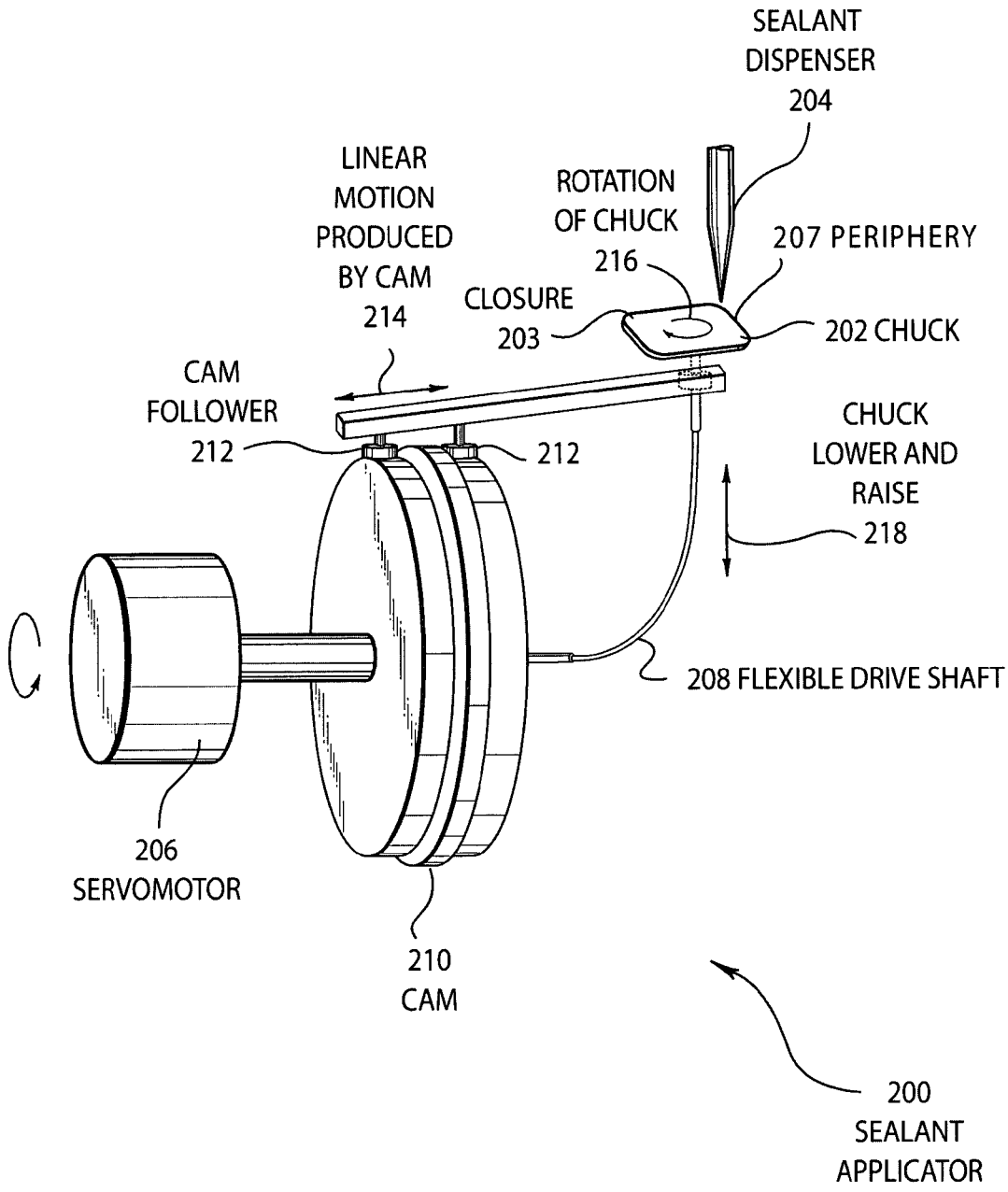
FIG. 2 is an illustration of a one embodiment of the present invention wherein linear motion is driven by a cam.

FIG. 2 illustrates a schematic representation of an embodiment 200 of the present invention. A chuck 202 is positioned under and in alignment with a sealant dispenser 204. A fixedly mounted servomotor 206 is coupled to the chuck 202 with a flexible drive shaft 208. A cam 210 is driven by the servomotor 206 and produces a linear motion 214 in a single direction along an axis in the plane of chuck 202 as a result of the cam followers 212 being mechanically coupled to chuck 202. The rotation of the chuck 216 together with the cam motion 214 causes the edge or periphery 207 of a closure 203 to remain directly under, and in alignment with, the sealant dispenser 204. The flexible shaft 208 also makes possible the vertical motion 218 used to load and unload closures 203 from the apparatus.

The present embodiment 200 has a minimal amount of mass that needs to be translated and rotated during the sealant application sequence. The servomotor 206 may be fixedly mounted to a machine frame or the like. Only the carriage and various lighter weight components need to be rotated and/or translated during a dispensing procedure although an entire servo system can be moved, if desired. For example, a fully integrated servomotor system that includes a motor, a controller for controlling the speed of the motor, an amplifier and a shaft encoder, which is a feedback device, that provides information regarding the position of the shaft, can be moved in the direction of linear motion 110 or up and down in the direction of motion 114, or any direction including motion 112. Certain advantages can be obtained by using such an integrated servomotor system, as set forth below. The servomotor 206 may be fixedly mounted such that the weight of the motor does not have to be translated back and forth.

In high speed machinery, translation of large amounts of mass, such as a servomotor that may weigh a few pounds, can limit the speed at which a machine may be able to perform. By mounting the servomotor 206 off the moving carriage, the amount of mass may be reduced from several pounds to several ounces. The decreased mass means less wear and tear on the machine, less vibration, less power required, and increased speeds. Fully integrated servomotor systems, however, are relatively light weight and do not have the disadvantages of previous servo systems, as set forth below.

The cam 210 provides a mechanical mechanism to generate the linear motion 214. The cam 210 has the advantage that the relationship between the linear motion 214 and rotational motion 216 is fixed, rigid, and ultimately reliable. In other embodiments where the linear motion 214 may be decoupled from the rotational motion 216, the relationship between the two motions can be maintained by a computerized controller or by other techniques known in the art. A disadvantage to the cam 210 is that the changeover from one type of closure to a second type of closure may require a mechanical replacement of the cam 210. Changes to such a system may be time consuming, while simple reprogramming of a computerized controller is all that is required for computerized servo systems.

Figure 3:
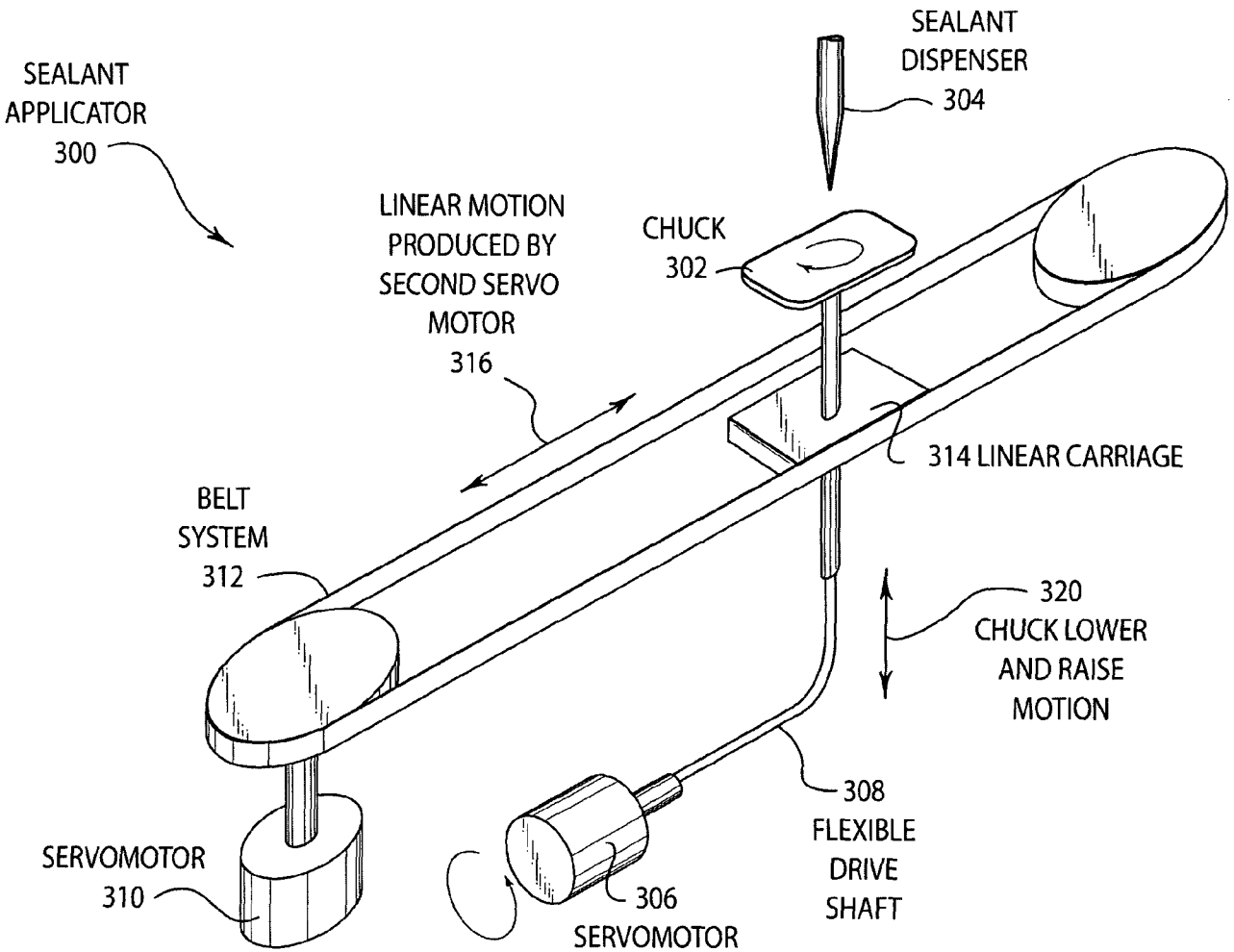
FIG. 3 is an illustration of another embodiment of the present invention wherein linear motion is produced by a second servomotor.

FIG. 3 illustrates an embodiment 300 of the present invention wherein the linear motion is produced by a second servomotor 310. A chuck 302 is positioned underneath a sealant dispenser 304. A rotational servomotor 306 rotates the chuck 302 using a flexible drive shaft 308. A second servomotor 310, using a belt system 312 and carriage 314, is used to move the chuck 302 in a linear motion 316. The vertical motion 320 of the chuck is used to load and unload the closure on the chuck 302.

Embodiment 300 provides another mechanism in which the servomotor 306 may be fixedly mounted so that the mass of the servomotor 306 is not carried on the carriage 314. By minimizing the amount of mass in motion, the speed and reliability of the overall machine may be maximized. The rotational servomotor 306 and the linear servomotor 310 may be synchronized by a controller 309. The synchronization may be programmable and easily adjustable. Methods and devices for performing synchronization are known in the art. Further, the programmability allows changeover from one size or shape of a closure to another size or shape with a minimum of mechanical changes. Further, the adjustment of the motion profile of the chuck 302 may be made with software rather than by changing mechanical components, such as a cam profile.

The position of the rotational servomotor 306 may be in any position such that the servomotor 306 and the chuck 302 are in communication by the flexible drive shaft 308. Due to the flexibility of the drive shaft 308, the machine designer may place the servomotor 306 as dictated by machine design concerns such as the available framework for mounting the motor 306, proximity to control systems, or other requirements. The orientation of the servomotor 306 may be horizontal, vertical, or any other position.

In other embodiments, the servomotor 310, belt system 312, and carriage 314 may be replaced by other mechanisms known in the art for translating a carriage. For example, a linear servomotor may replace the motor 310, belt system 312, and carriage 314. In other embodiments, a carriage 314 may be propelled by a lead screw attached to a motor 310. In still other embodiments, the belt system 312 may be a toothed belt, an o-ring type belt, chain, or other endless, flexible medium. Those skilled in the art of machine design may create other embodiments using different linear motion mechanisms while remaining within the scope and intent of the present invention.

Figure 4:
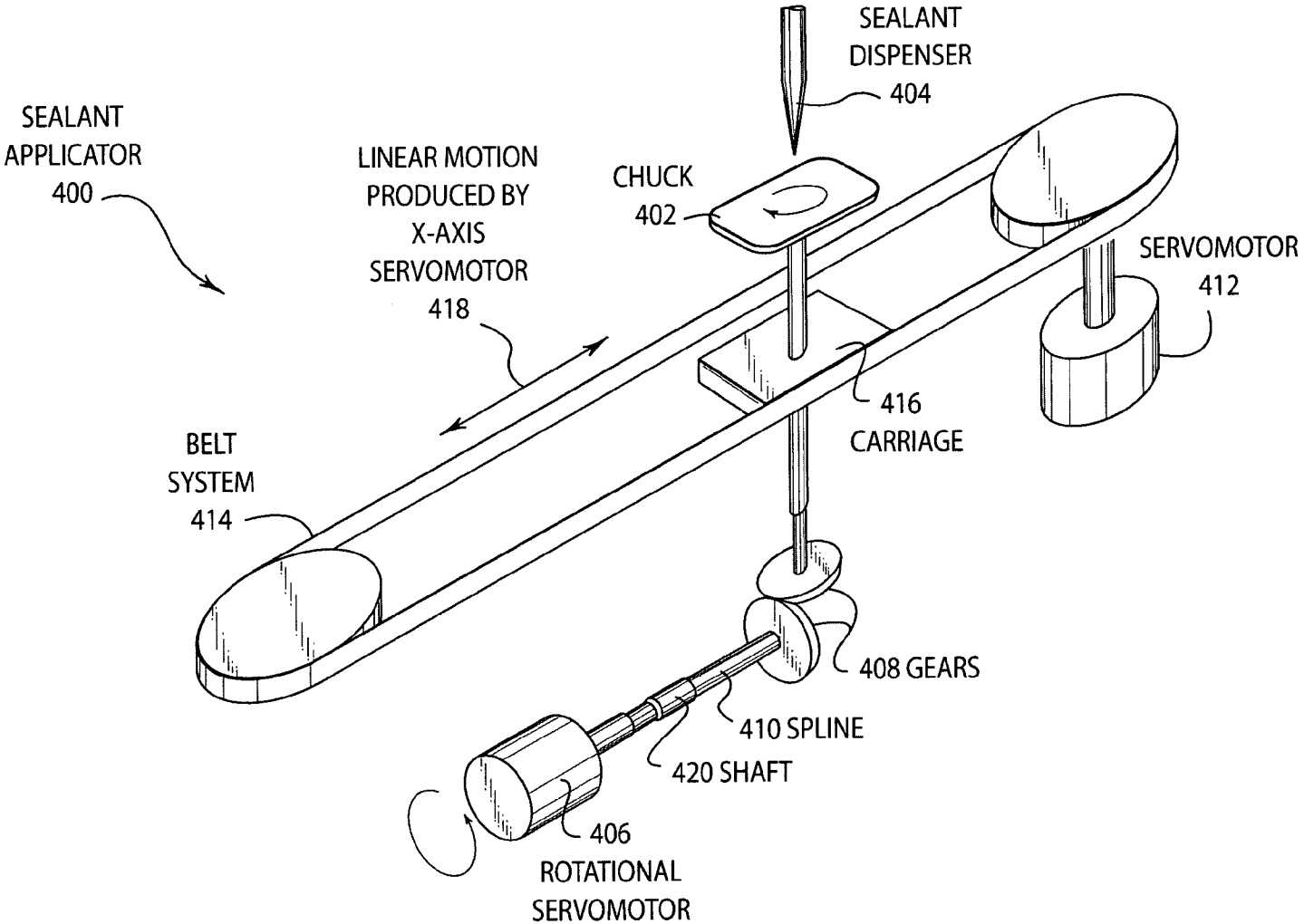
FIG. 4 is an illustration of another embodiment of the present invention wherein a rotational motion is coupled by a spline and gears.

FIG. 4 illustrates another embodiment 400 of a sealant applicator. A chuck 402 is positioned underneath and aligned with a fixedly mounted sealant dispenser 404. A rotational servomotor 406 is connected to the chuck 402 through a shaft 420, spline 410 and gears 408. A second servomotor 412 is connected through a belt system 414 to a carriage 416 to produce a linear motion 418 of the chuck 402.

Embodiment 400 differs from embodiment 300 in that the connection of the rotational motor 406 to the chuck 402 is through a spline 410 and gears 408. The spline 410 allows the motor 406 to be fixedly mounted while the carriage 416 is moved in the direction 418. The rotation of the shaft 420 may still occur while the linear distance between the motor 406 and carriage 416 changes during the application of the sealant material.

Figure 5:
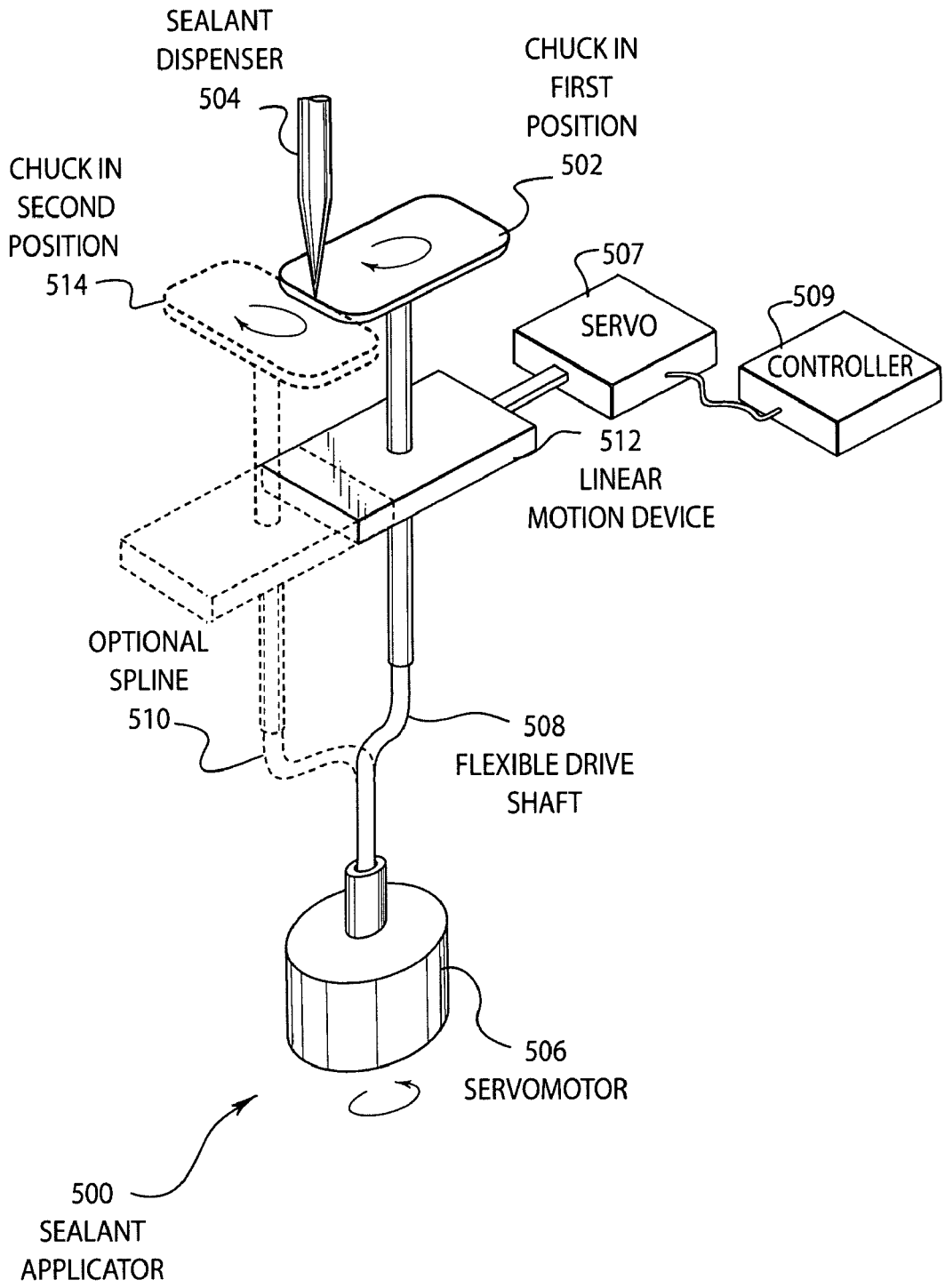
FIG. 5 is an illustration of another embodiment of the present invention wherein a rotational motor is mounted below a chuck and coupled with a flexible drive shaft.

FIG. 5 illustrates yet another embodiment 500 of a sealant applicator. A chuck 502 is positioned underneath and aligned with a sealant dispenser 504. A rotational servomotor 506 is connected to the chuck 502 with a flexible drive shaft 508 and an optional spline 510. A linear motion device 512 is connected to a servo 507, which is in turn connected to a controller 509, that function together to move the chuck 502 horizontally underneath the dispenser 504. A second position 514 of the chuck 502 is also shown.

The embodiment 500 illustrates the mounting of the rotational servomotor in a vertical orientation and the coupling of the rotational servomotor to the chuck 502 with a flexible drive shaft 508. In some cases, a spline 510 may be needed to account for the changing distance between the fixed mounted motor 506 and the chuck 502. In other cases, the flexible drive shaft 508 may be mounted in such a manner that a spline 510 is not necessary.

The spline 510 may be necessary to allow the chuck 502 to move in a vertical motion to present the closure to the sealant dispenser 504. In other cases, the sealant dispenser 504 may be adapted to move vertically in lieu of the vertical motion of the chuck 502. In such an embodiment, the sealant dispenser 504 may be restricted to moving vertically and not in the plane of motion perpendicular to the axis of rotation of the chuck 502.

The linear motion device 512 may be a linear motor, lead screw driven carriage, belt driven carriage, or other device known in the art to move the chuck 502 back and forth in a linear motion, or may be connected to servo 507, which is controlled by controller 509.

Figure 6:
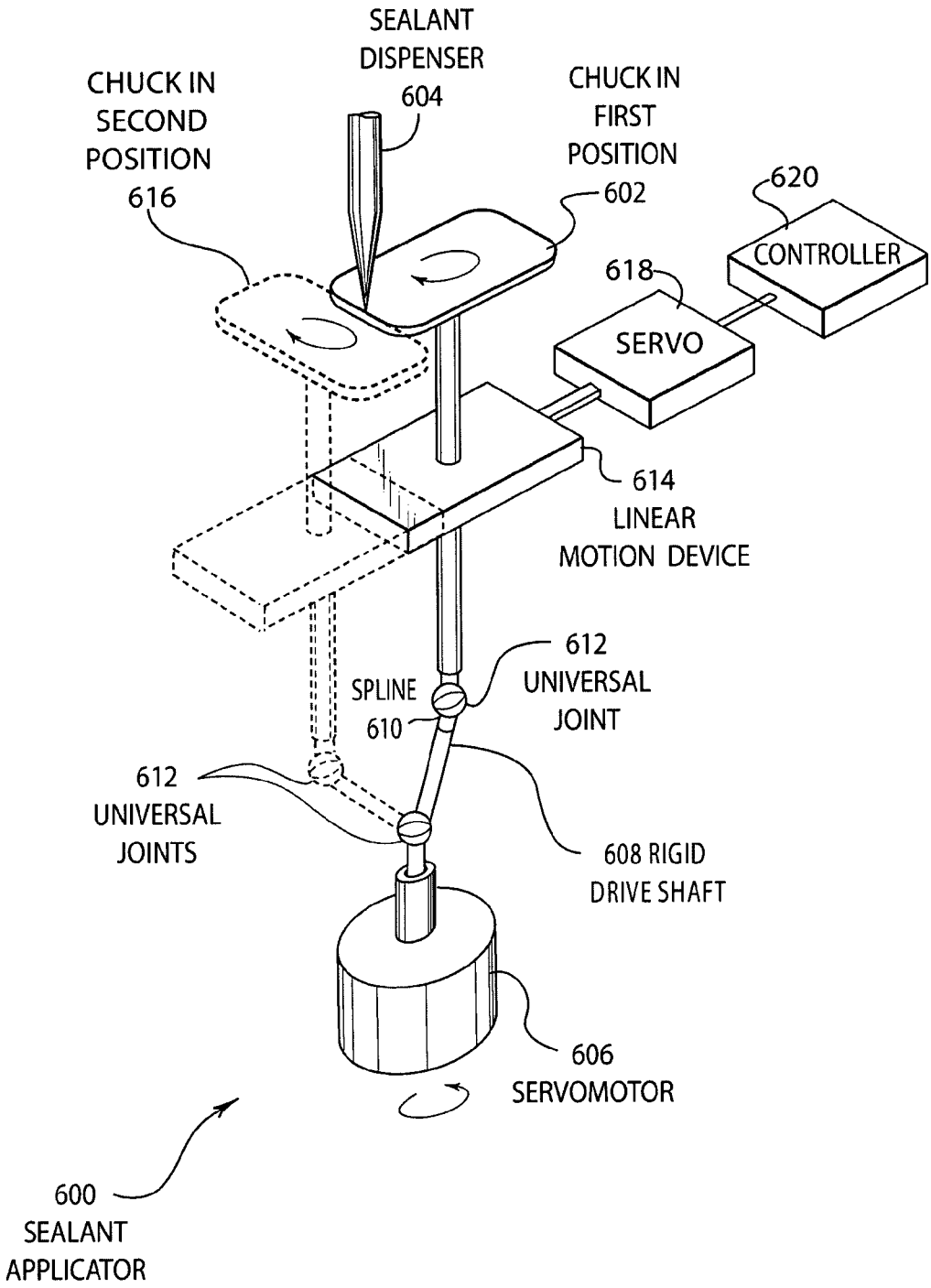
FIG. 6 is an illustration of another embodiment of the present invention wherein a rotational motor is mounted below a chuck and coupled with a rigid drive shaft.

FIG. 6 illustrates another embodiment 600 of a sealant applicator. A chuck 602 is positioned underneath and in alignment with a sealant dispenser 604. A rotational servomotor 606 is connected to the chuck 602 through a rigid drive shaft 608, a spline 610, and universal joints 612. The chuck 602 is moved side to side by a linear motion device 614, or by servo 618 which is controlled by controller 620. The chuck 602 is also shown in a second position 616.

The embodiment 600 differs from embodiment 500 in that a rigid drive shaft 608 is used instead of a flexible drive shaft 508 of embodiment 500. The rigid drive shaft 608 may have higher load carrying capability or better repeatability than a flexible drive shaft in some cases.

The universal joints 612 may be yoke-type universal joints, or may be any of various forms of couplers so that the drive shaft 608 may be coupled to the motor 606 and transmit rotational force during a change in axis. Such couplers include pliable rubber couplers, constant velocity joints, or any other such coupler.

Figure 7:
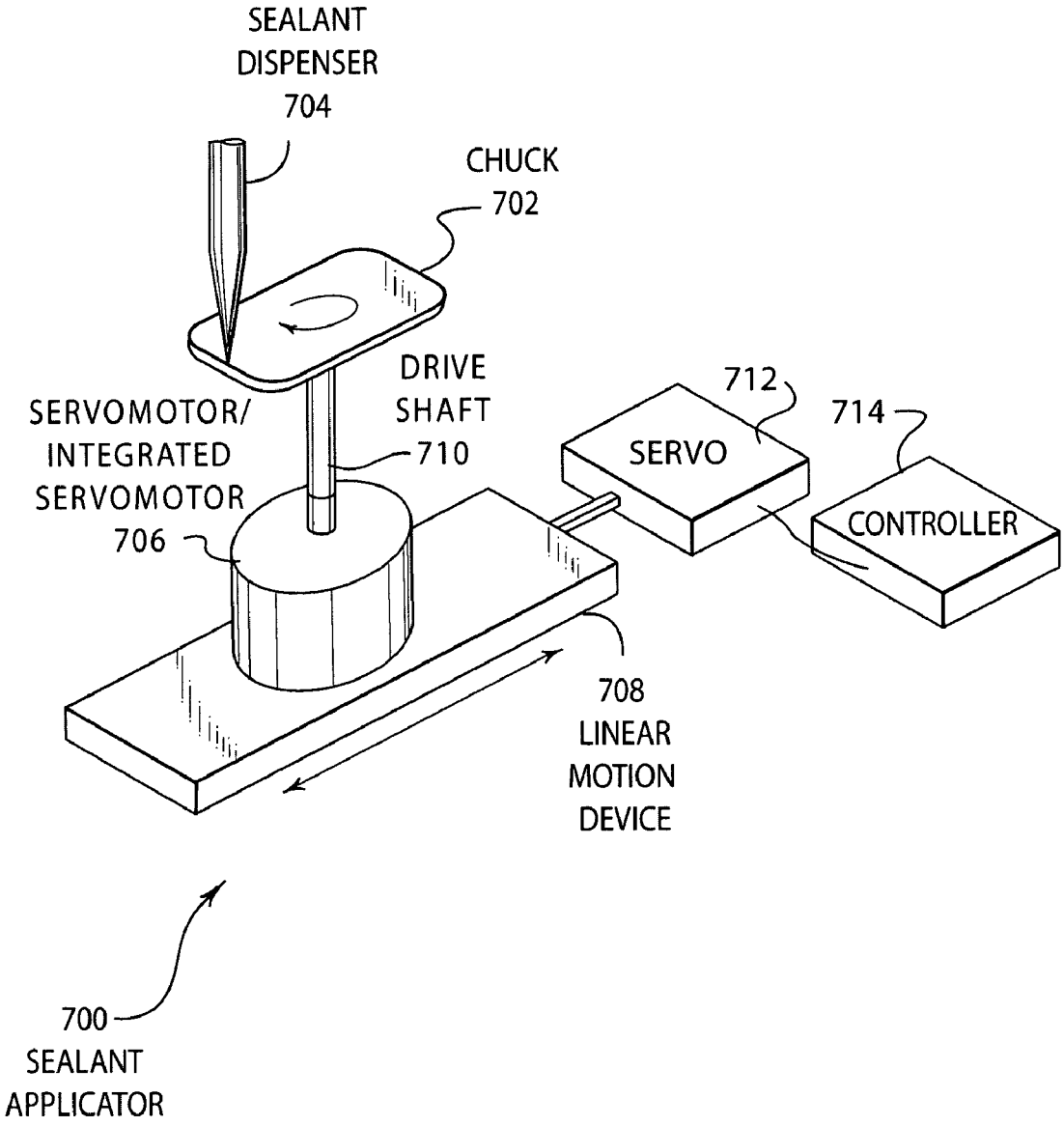
FIG. 7 is an illustration of another embodiment of the present invention wherein a rotational motor is mounted on a moving linear slide.

FIG. 7 illustrates another embodiment 700 of a sealant applicator. A chuck 702 is positioned underneath a sealant dispenser 704. A rotational servomotor or fully integrated servomotor 706 is connected to the chuck 702 through a rigid drive shaft 710. An integrated servomotor may comprise a servomotor that incorporates, into one integral package, additional parts, other than the motor and feedback device of a servomechanism, such as an amplifier, controller and/or a shaft encoder. The rotational servomotor 706 is moved side to side by a linear motion device 706, or by servo 712 that is controlled by controller 714. The linear motion device 708 may be a system of belts and pulleys, a lead screw driven stage, or any other linear motion device.

In the present embodiment, the motor/servomotor/integrated servomotor 706 is moved back and forth and contributes to the mass moved by the linear motion device 708. While this mass can be more than some other embodiments, the mass of the sealant dispenser 704 as well as the related connectors and hoses may be more than the mass and related encumbrances of the motor 706.

Figure 8:
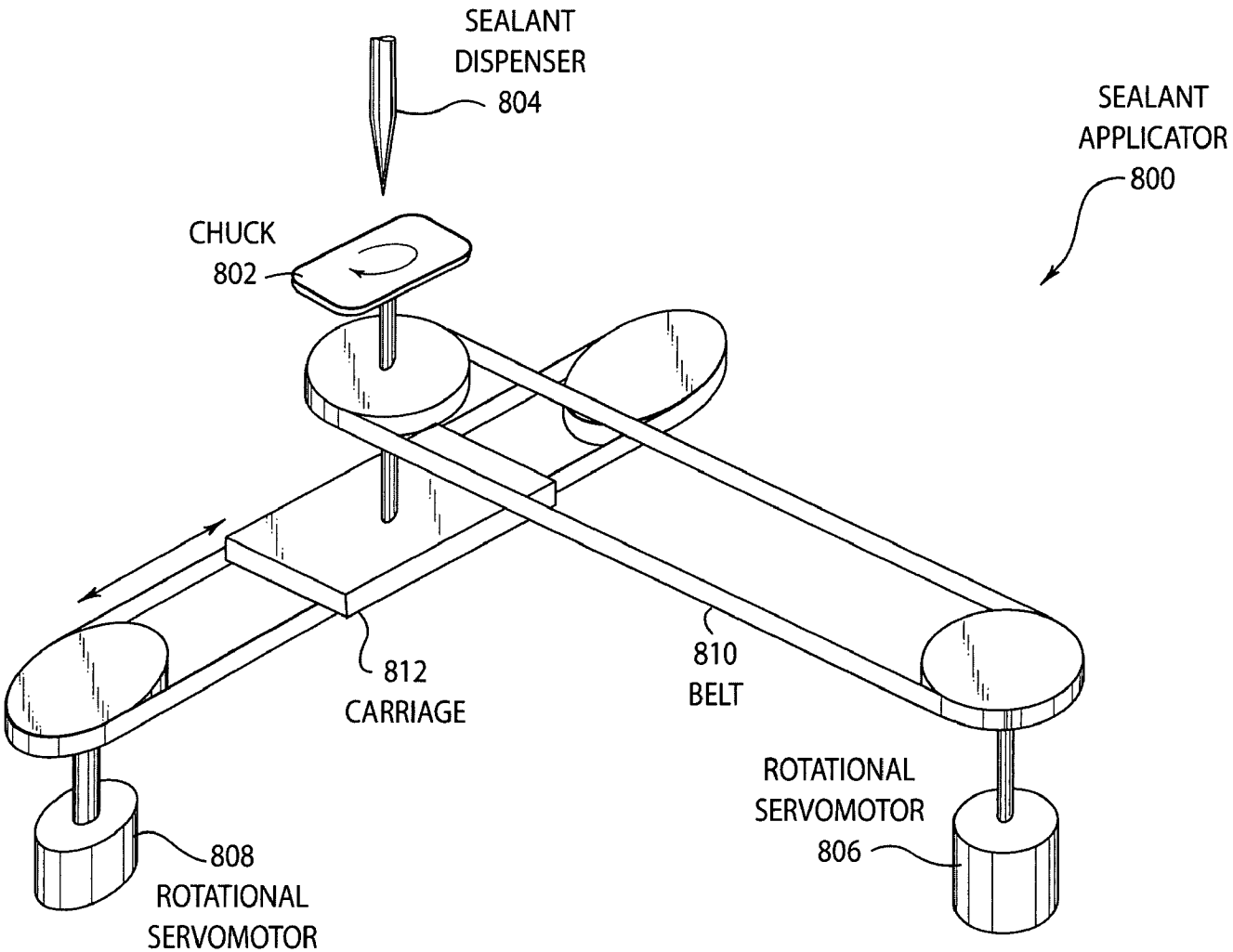
FIG. 8 is an illustration of another embodiment of the present invention wherein both the linear and rotational motors are fixed mounted.

FIG. 8 illustrates yet another embodiment 800 of a sealant applicator. A chuck 802 is positioned underneath a sealant dispenser 804. A fixedly mounted rotational servomotor 806 and a fixedly mounted linear servomotor 808 control the position of the chuck 802. The rotational motion of the chuck 802 is transmitted through a belt 810 to the carriage 812. The carriage 812 moves linearly and is controlled by the linear servomotor 808. For the chuck 802 to rotate without linear motion, the rotational servomotor 806 is turned. For the chuck 802 to move linearly without rotational motion, both the rotational servomotor 806 and the linear servomotor 808 must rotate at the same time. The embodiment 800 has the advantage that the moving mass of the mechanism is minimal, however, there is an additional complexity in synchronizing the motion of the motors.

Figure 9:
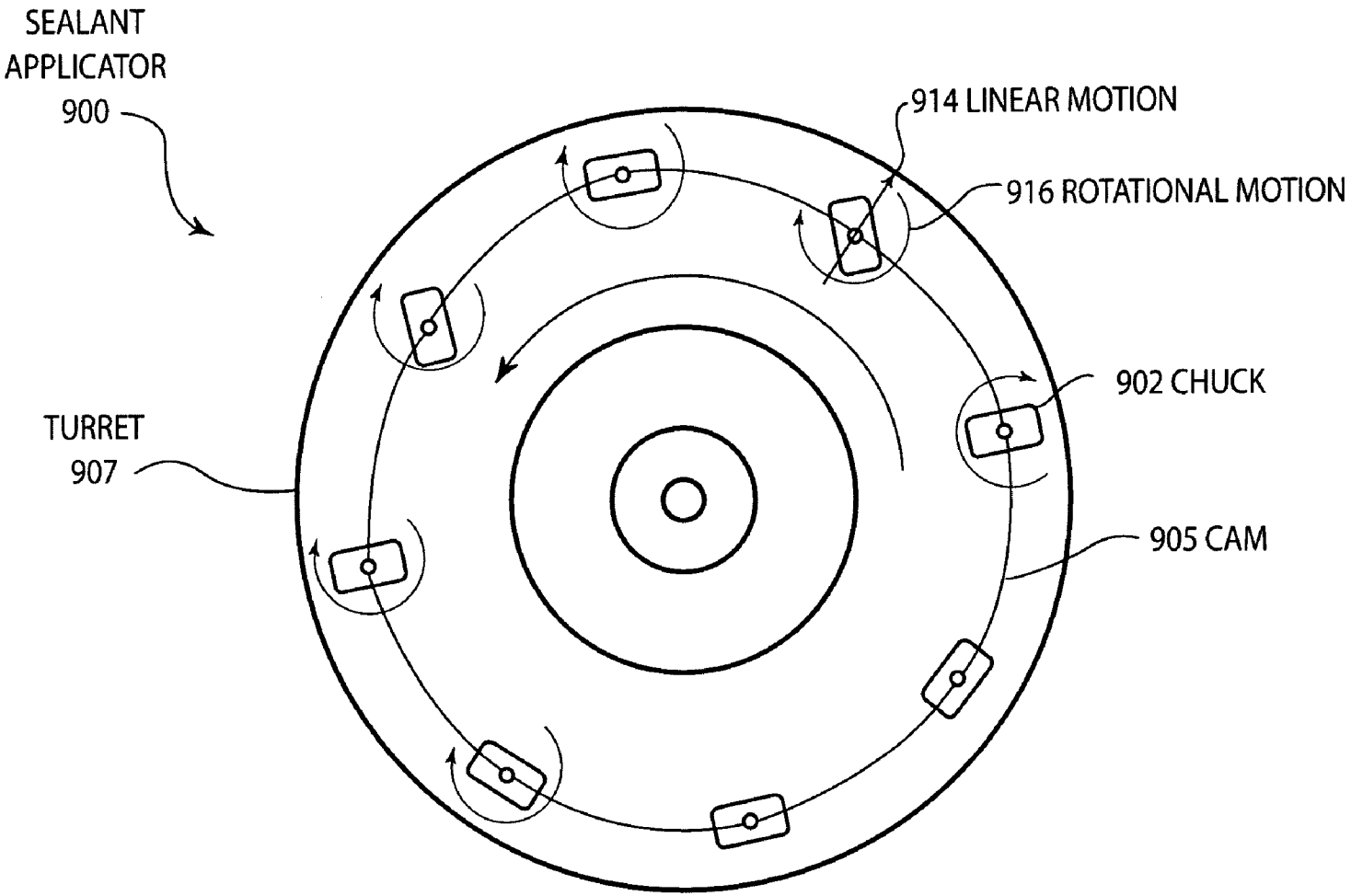
FIGS. 9 and 10 are an illustration of another embodiment of the present invention wherein multiple rotational motors and liner sealant dispensers are mounted on a rotating turret and the linear motion is derived by the rotation of the turret around a cam.
Figure 10:
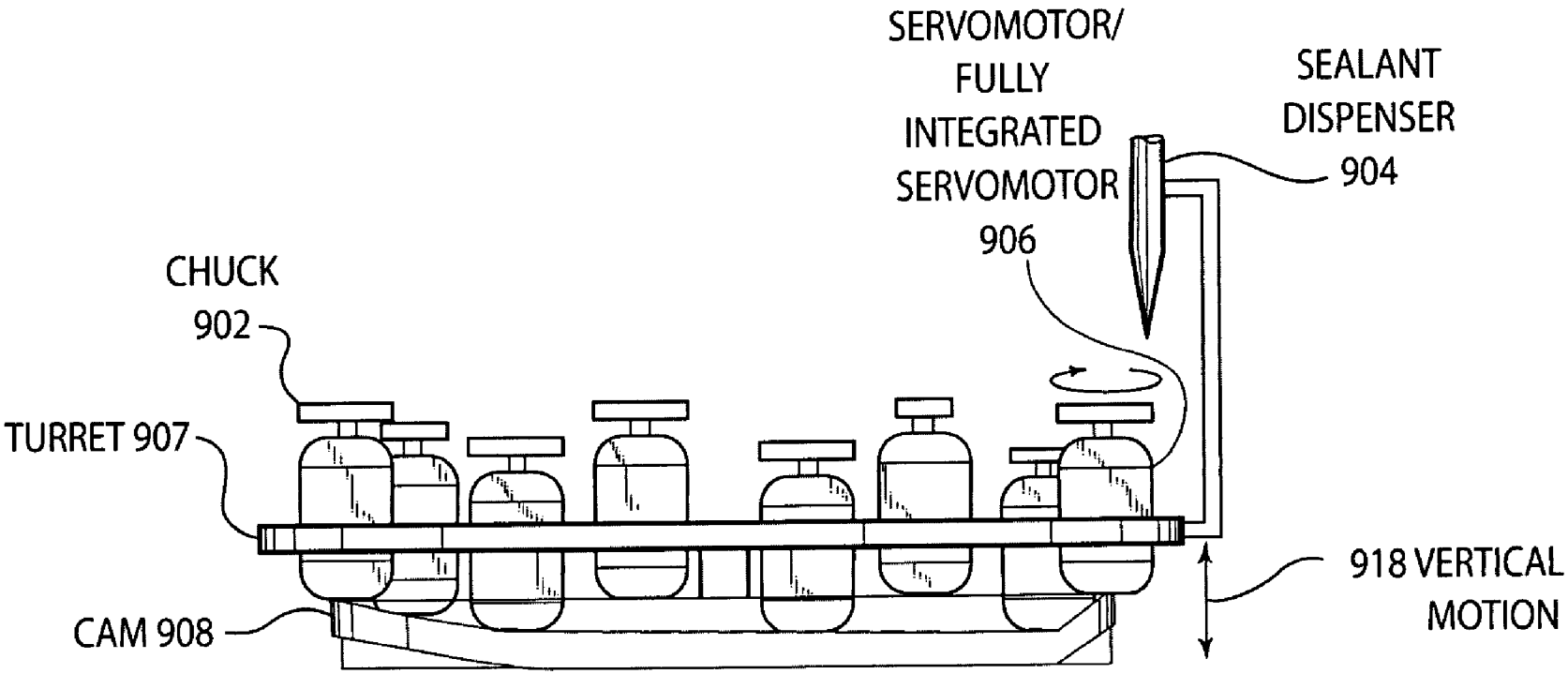

FIGS. 9 and 10 are a schematic representation of another embodiment 900 of a sealant applicator. Each chuck 902 is positioned under and aligned with a fixedly mounted sealant dispenser 904. Servomotors 906 may comprise standard motors with remotely located controllers, or fully integrated servomotors that include the controller, amplifier, shaft encoder and the motor. In fact, each of the embodiments disclosed herein may use standard motors, servomotors or fully integrated servomotors, as desired. Each motor/integrated servomotor 906 is directly connected to a chuck 902. The motors/integrated servomotors 906 are mounted on a turret 907. The turret 907 is rotated around two cams 905, 908. Rotation around the cam 905 produces a linear motion 914 along the radius of the turret 907. The rotation of the chuck 916 coupled with the cam motion 914 maintains the periphery of a closure directly under and aligned with the sealant dispenser 904. Rotating the turret around cam 908 lifts the motors and chucks which produces the vertical motion 918 that is used to load and unload closures from the sealant applicator 900. The linear motion produced by cam 905 may also comprise system of belts and pulleys, a lead screw driven stage, servomotor, or any other linear motion device. Those skilled in the art of machine design may create other embodiments using different linear motion mechanisms while remaining within the scope and intent of the present invention.

Embodiment 900 can have single or multiple lining stations. Each chuck 902 has its own servomotor 906 making chuck rotation and velocity independent of the other chucks during the loading, unloading and sealant application sequence. The servomotor 906 may be a self-contained, fully integrated servomotor, or just the motor, as set forth above.

The cam 905 provides a mechanism to generate the linear motion 914. The cam 905 has the advantage that the linear motion 914 can be distributed over a greater distance by increasing the radius of the turret. This can reduce the forces necessary to generate the motion 914 which ultimately makes the sealant applicator 900 more reliable. Since the linear motion 914 is decoupled from the rotational motion 916, the relationship between the two motions must be maintained by a computerized controller, or by other techniques known in the art. A disadvantage associated with the use of cam 905 is that the changeover from one type of closure to a second type of closure may require a mechanical replacement of the cam 905. Such a changeover may be time consuming. A computerized controller for controlling the motion can be used so that simple reprogramming of the controller produces the desired motion. The use of multiple chucks results in less vibration, less wear and tear on the sealant applicator 900, and increased production speeds.

Figure 11:
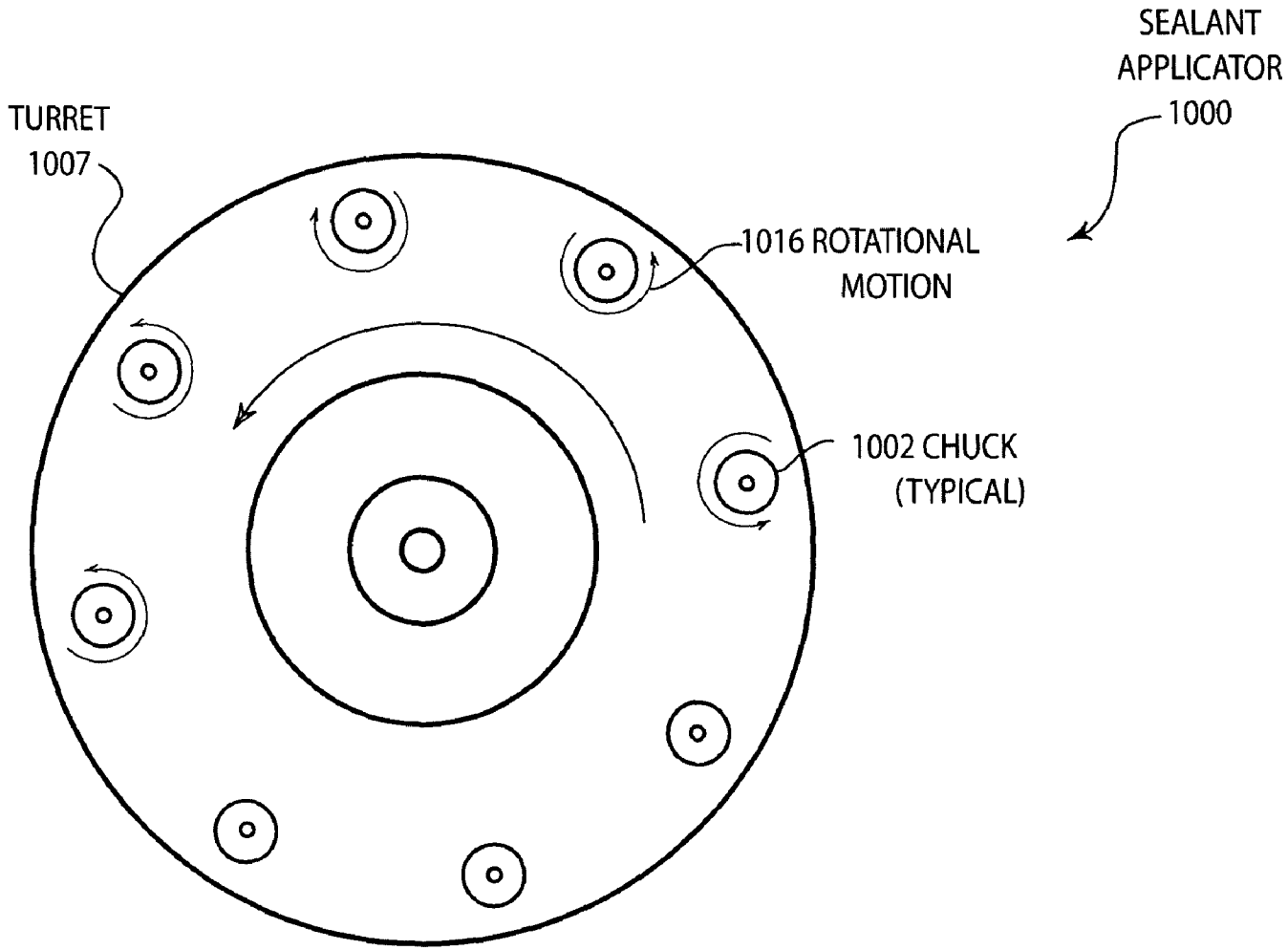
FIGS. 11 and 12 are an illustration of another embodiment of a sealant applicator that is used for circular closures.
Figure 12:
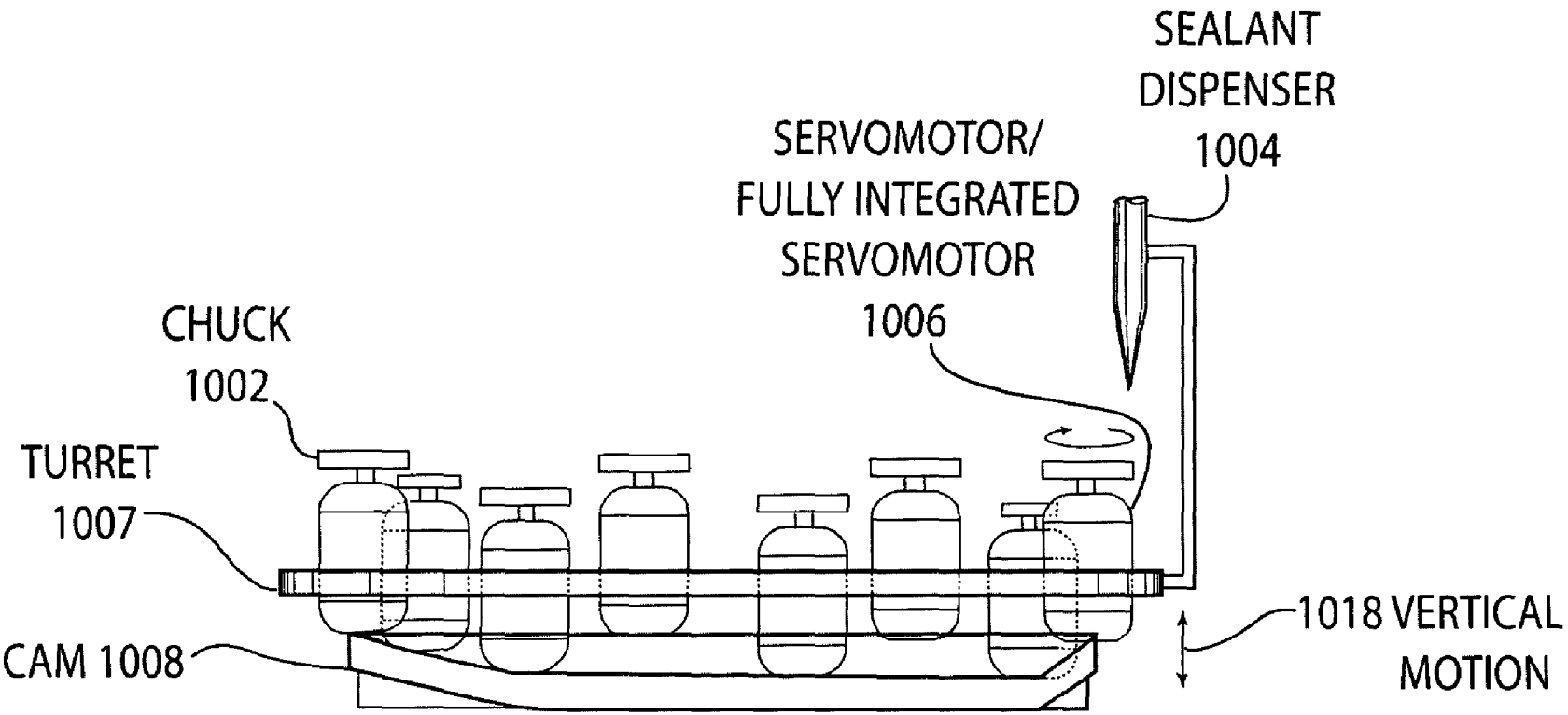

FIGS. 11 and 12 illustrate another embodiment 1000 of a sealant applicator that is used for circular closures. As shown in FIG. 12, chucks 1002 are positioned under and aligned with a sealant dispenser 1004. Multiple servomotors 1006 are mechanically coupled to chucks 1002. Servomotors 1006 can comprise fully integrated servomotors, or standard motors that have controllers and/or other apparatus not located directly on the motor. The motors/integrated servomotors 1006 are connected to a turret 1007. Rotation of the turret 1007 around cam 1008 lifts the motors/integrated servomotors 1006 and chucks 1002 which provides the vertical motion 1018 used to load and unload closures from the sealant applicator 1000.

Embodiment 1000 may have single or multiple lining stations. Each chuck 1002 has its own motor or fully integrated servomotor 1006 such that the chuck rotation and velocity are independent of the rotation of the turret and of the other chucks, during the loading, unloading and sealant application sequence. The motors 1006 may be fully integrated servomotors or standard servomotors, as indicated above, that can be independently controlled from each of the other motors/integrated servomotors Hence, various embodiments disclosed herein function to minimize the moving mass during dispensing of sealant materials to closures. This is accomplished by capturing the closure on a chuck that is translated and rotated beneath a fixed mounted sealant dispenser. A fixedly mounted motor in various embodiments is coupled to a rotating chuck through various mechanisms.

Another advantage of the various embodiments disclosed herein is that the constantly changing position of the closure during the application of the sealant maintains a constant volume of sealant along the periphery of the closure. Unlike the prior art, the embodiments disclosed herein maintain the distance and angle of presentation between the sealant dispenser and the closure which further aids in maintaining constant volume of sealant dispensed along the periphery. Further, various embodiments disclosed herein provide improved liners by permitting the chuck to be independently controlled during the loading, unloading, and application of the sealant, while the chuck and sealant applicator are rotated on a turret.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A closure sealant applicator machine for dispensing sealant to a periphery of non-circular closures comprising:

a sealant dispenser substantially fixedly mounted to said sealant applicator machine;

a chuck to hold said closure in a plane;

a rotational motor directly connected by a drive shaft to said chuck, to rotate the chuck along an axis substantially perpendicular to said plane;

a translational mechanism to linearly move said chuck the, rotational motor, and the drive shaft along at least one axis within said plane; and a controller to simultaneously rotate and translate said closure with respect to said sealant dispenser to maintain said periphery of said closure in alignment with said sealant dispenser while said sealant dispenser dispenses said sealant.

2. A closure sealant applicator machine for dispensing sealant to a periphery of non-circular closures comprising:

a sealant dispenser mounted in close proximity to a non-circular closure wherein the periphery of the non-circular closure defines a plane;

rotational means for rotating the non-circular closure with a directly connected drive shaft defining an axis substantially perpendicular to the plane;

translational means for moving the non-circular closure and the drive shaft along at least one axis within said plane; and controller means for rotating and translating non-circular closure with respect to the sealant dispenser to maintain the periphery of said closure in alignment with the sealant dispenser while the sealant dispenser dispenses the sealant onto the closure.

3. A closure sealant applicator machine for dispensing sealant to a periphery of non-circular closures comprising:

a sealant dispenser substantially fixedly mounted to a sealant applicator machine;

the non-circular closure mounted in close proximity to the sealant dispenser wherein the periphery of the non-circular closure defines a plane;

a rotational motor directly connected to a chuck by a drive shaft closure to rotate the non-circular closure along an axis substantially perpendicular to the plane;

a translational mechanism to linearly move the non-circular closure and the drive shaft along at least one axis within the plane; and a controller to simultaneously rotate and translate the closure with respect to the sealant dispenser to maintain the periphery of the closure in alignment with the sealant dispenser while the sealant dispenser dispenses the sealant.

4. A closure sealant applicator machine for dispensing sealant to a periphery of non-circular closures as recited in claim 3 wherein linear motion is driven by a cam.

5. A closure sealant applicator machine for dispensing sealant to a periphery of non-circular closures as recited in claim 3 wherein linear motion is produced by a servomotor.

6. A closure sealant applicator machine for dispensing sealant to a periphery of non-circular closures as recited in claim 3 wherein a rotational motion is coupled by a spline and gears.

7. A closure sealant applicator machine for dispensing sealant to a periphery of non-circular closures as recited in claim 3 wherein the rotational motor is mounted below the chuck and the shaft is a flexible drive shaft.

8. A closure sealant applicator machine for dispensing sealant to a periphery of non-circular closures as recited in claim 3 wherein the rotational motor is mounted below a chuck and coupled with a rigid drive shaft.

9. A closure sealant applicator machine for dispensing sealant to a periphery of non-circular closures as recited in claim 3 wherein the rotational motor is mounted on a moving linear slide.

10. A closure sealant applicator machine for dispensing sealant to a periphery of non-circular closures as recited in claim 3 wherein both the translational mechanism and rotational motor are fixedly mounted.

11. A closure sealant applicator machine for dispensing sealant to a periphery of non-circular closures as recited in claim 3 wherein multiple rotational motors and sealant dispensers are mounted on a rotating turret and the linear motion is derived by the rotation of the turret around a cam.

* * * * *